US009283144B2

(12) United States Patent
Bickerstaffe et al.

(10) Patent No.: US 9,283,144 B2
(45) Date of Patent: Mar. 15, 2016

(54) MANUAL BIDET

(75) Inventors: Mark S. Bickerstaffe, Clevedon (GB); Bruno J. Chenesseau, L'lle-Saint-Denis (FR); Zunqing Zang, Shanghai (CN); Ziyi Yuan, Meishan (CN); John A. Teubert, Madison, AL (US)

(73) Assignee: KOHLER CO., Kohler, WI (US)

( * ) Notice: Subject to any disclaimer, the term of this patent is extended or adjusted under 35 U.S.C. 154(b) by 593 days.

(21) Appl. No.: 13/697,951

(22) PCT Filed: Oct. 21, 2011

(86) PCT No.: PCT/CN2011/081146

§ 371 (c)(1),
(2), (4) Date: Nov. 14, 2012

(87) PCT Pub. No.: WO2013/056471

PCT Pub. Date: Apr. 25, 2013

(65) Prior Publication Data

US 2013/0152296 A1 Jun. 20, 2013

(51) Int. Cl.

| | |
|---|---|
| ***A47K 3/022*** | (2006.01) |
| ***A61H 35/00*** | (2006.01) |
| ***E03D 9/08*** | (2006.01) |

(52) U.S. Cl.

CPC . *A61H 35/00* (2013.01); *E03D 9/08* (2013.01)

(58) Field of Classification Search

CPC ..... E03D 9/08
USPC ..... 4/420.4, 420.5, 444
See application file for complete search history.

(56) References Cited

U.S. PATENT DOCUMENTS

| | | | | |
|---|---|---|---|---|
| 2,278,055 | A | 3/1942 | Bigio | |
| 2,852,782 | A | 9/1958 | Sundberg | |
| 5,384,919 | A * | 1/1995 | Smith | 4/420.4 |
| 2004/0154088 | A1 | 8/2004 | Aono | |

FOREIGN PATENT DOCUMENTS

| | | | |
|---|---|---|---|
| CN | 101068990 | A | 11/2007 |
| CN | 101683247 | A | 3/2010 |

(Continued)

OTHER PUBLICATIONS

International Search Report and Written Opinion for International Application No. PCT/CN2011/081146, dated Aug. 16, 2012, 7 pages.

(Continued)

*Primary Examiner* — Tuan N Nguyen
(74) *Attorney, Agent, or Firm* — Foley & Lardner LLP

(57) ABSTRACT

According to an exemplary embodiment, a bidet assembly for a toilet generally includes a sprayer, a water supply system, and an arm. The sprayer is configured to spray water. The water supply system is configured to selectively communicate water from one or more water sources to the sprayer. The arm is operationally coupled to the water sprayer and the water supply system. The arm is configured such that rotation of the arm acts to rotate the sprayer and the arm forger comprises a feature configured to allow control of the amount of water flow from the water supply to the sprayer.

26 Claims, 5 Drawing Sheets

(56) References Cited

FOREIGN PATENT DOCUMENTS

| | | | |
|---|---|---|---|
| DE | 29612680 | U1 | 3/1997 |
| JP | 2002294822 | A | 10/2002 |
| JP | 2009215758 | A | 9/2009 |
| WO | WO 92/08851 | A1 | 5/1992 |
| WO | WO 95/00721 | A1 | 1/1995 |
| WO | WO 2006/095492 | A1 | 9/2006 |

OTHER PUBLICATIONS

International Preliminary Report on Patentability dated May 1, 2014 in PCT Application No. PCT/CN2011/081146 (6 pages).
Supplementary Partial European Search Report regarding Application No. 11874196.6, dated Jun. 19, 2015, 6 pages.
Supplementary European Search Report regarding Application No. 11874196.6, dated Oct. 7, 2015, 9 pages.

* cited by examiner

MANUAL BIDET

BACKGROUND

Toilets may include bidet features, which are configured to spray water toward a user for cleaning or washing portions of the user. Such bidet features may include various expensive or complex components for actuating or moving a bidet sprayer, such as electronic motors, power supply systems, and control systems. It would be desirable to provide an improved bidet feature, which avoids expensive components and provides an intuitively operated bidet that is adaptable to a person's desired cleaning characteristics.

SUMMARY

According to an exemplary embodiment, a bidet assembly for a toilet generally includes a sprayer, a water supply system, and an arm. The sprayer is configured to spray water. The water supply system is configured to selectively communicate water from one or more water sources to the sprayer. The arm is operationally coupled to the water sprayer and the water supply system. The arm is configured such that rotation of the arm acts to rotate the sprayer, and the arm further comprises a feature configured to allow control of the amount of water flow from the water supply to the sprayer.

According to an exemplary embodiment, a toilet seat assembly includes a bidet assembly. The bidet assembly generally includes a sprayer, a water supply system, and an arm. The sprayer is configured to spray water. The water supply system is configured to selectively communicate water from one or more water sources to the sprayer. The arm is operationally coupled to the water sprayer and the water supply system. A user may move the arm to pivot the sprayer and to change water flow from the water supply to the sprayer.

According to an exemplary embodiment, a toilet includes a bidet assembly. The bidet assembly generally includes a sprayer, a water supply system, and a arm. The sprayer is configured to spray water. The water supply system is configured to selectively communicate water from one or more water sources to the sprayer. The arm is operationally coupled to the water sprayer and the water supply system. A user may move the arm to pivot the sprayer and to change water flow from the water supply to the sprayer.

DETAILED DESCRIPTION

Figure 1:
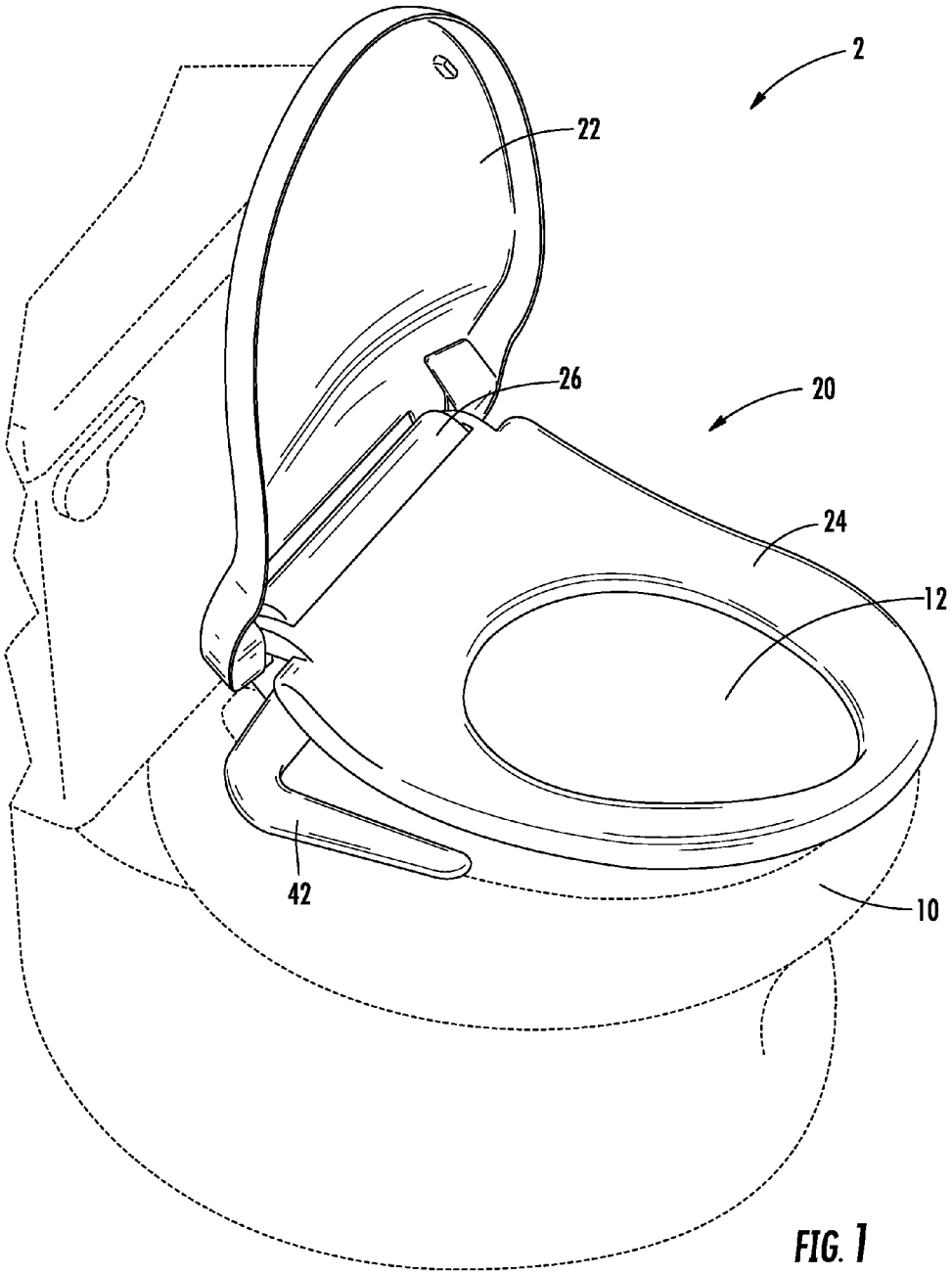
FIG. 1 is a perspective view of a toilet including a bidet assembly according to an exemplary embodiment.
Figure 2:
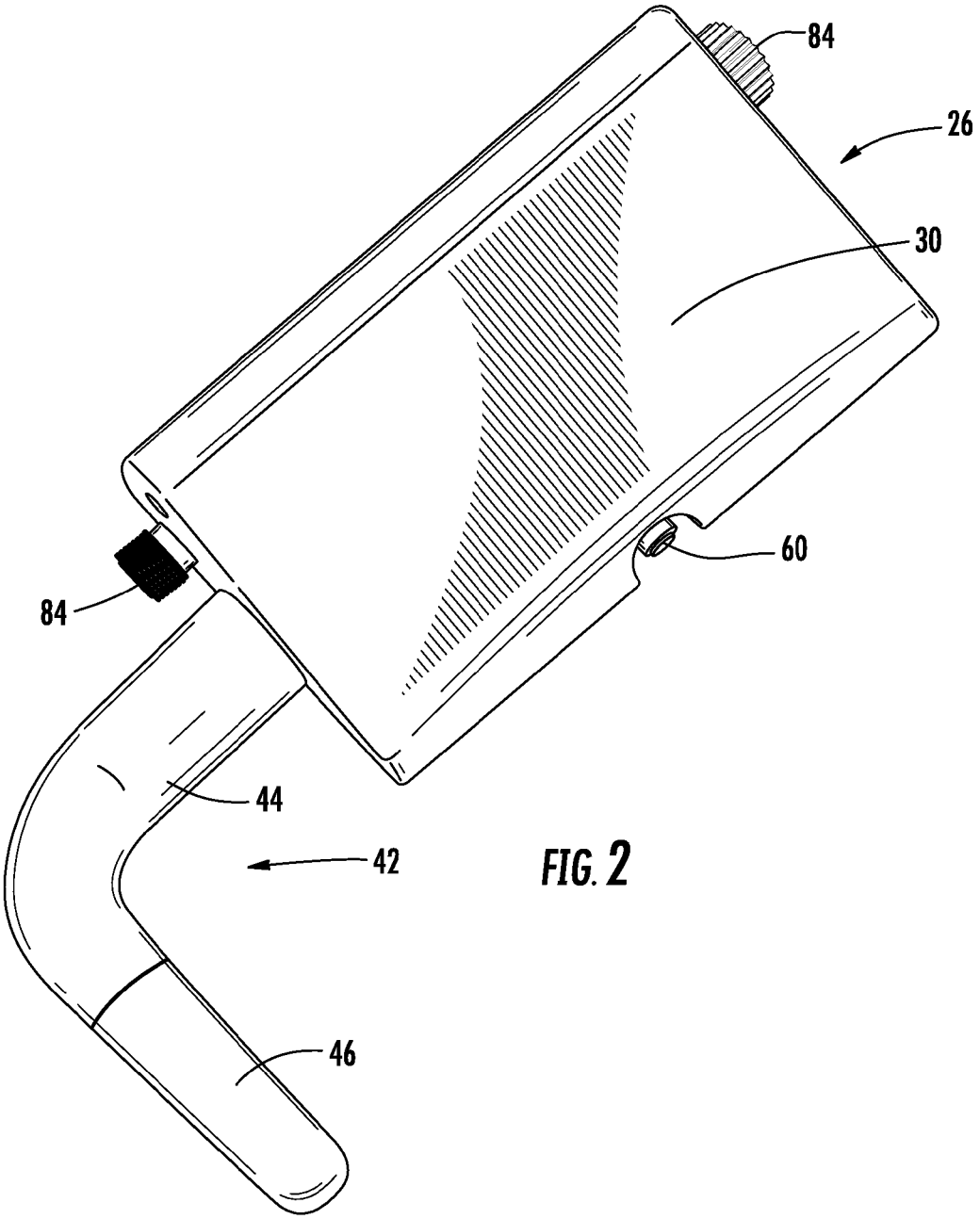
FIG. 2 is a perspective view of a bidet assembly according to an exemplary embodiment.
Figure 3:
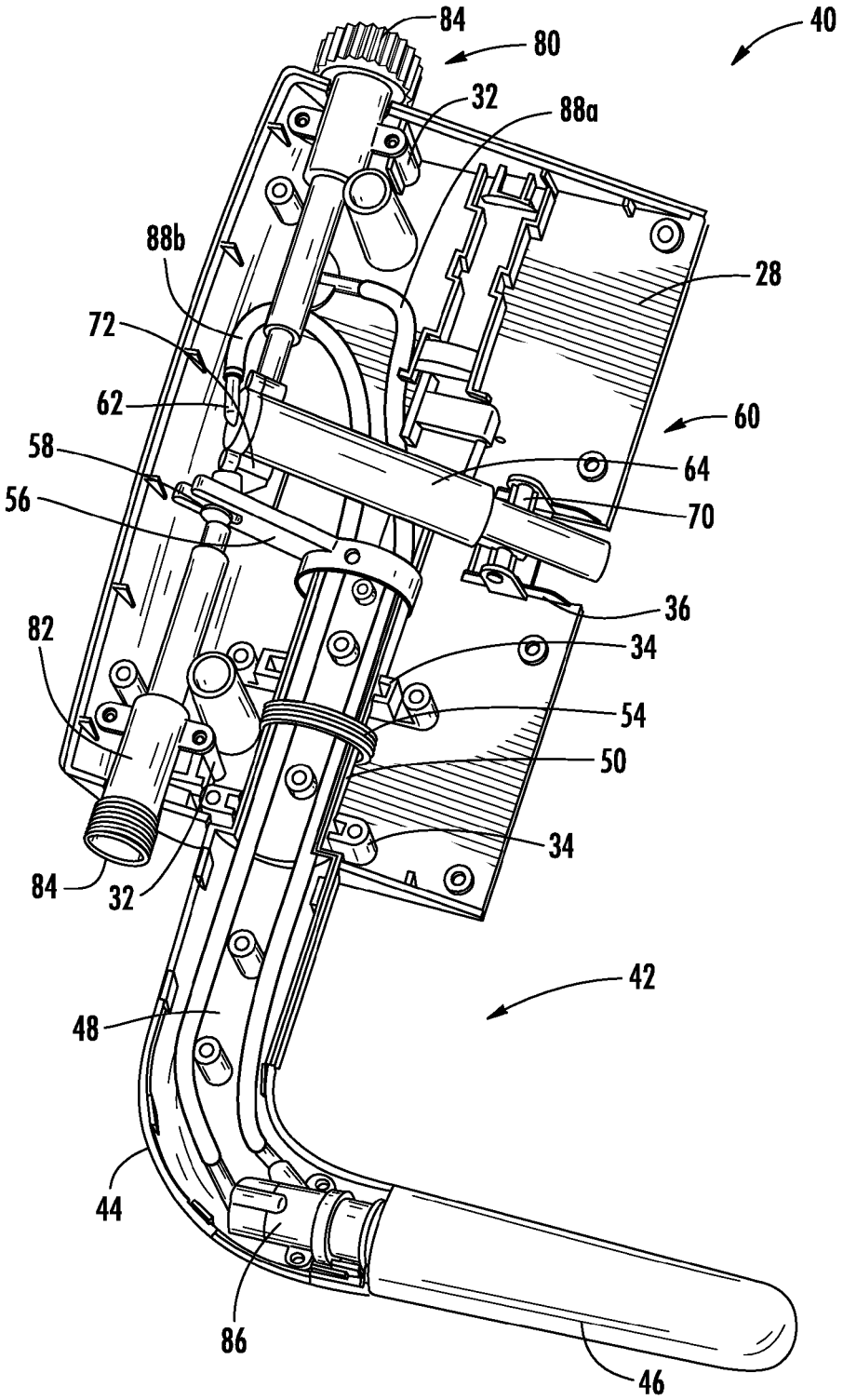
FIG. 3 is a perspective, partial cutaway view of a bidet assembly according to an exemplary embodiment with a sprayer shown in a retracted position.
Figure 4:
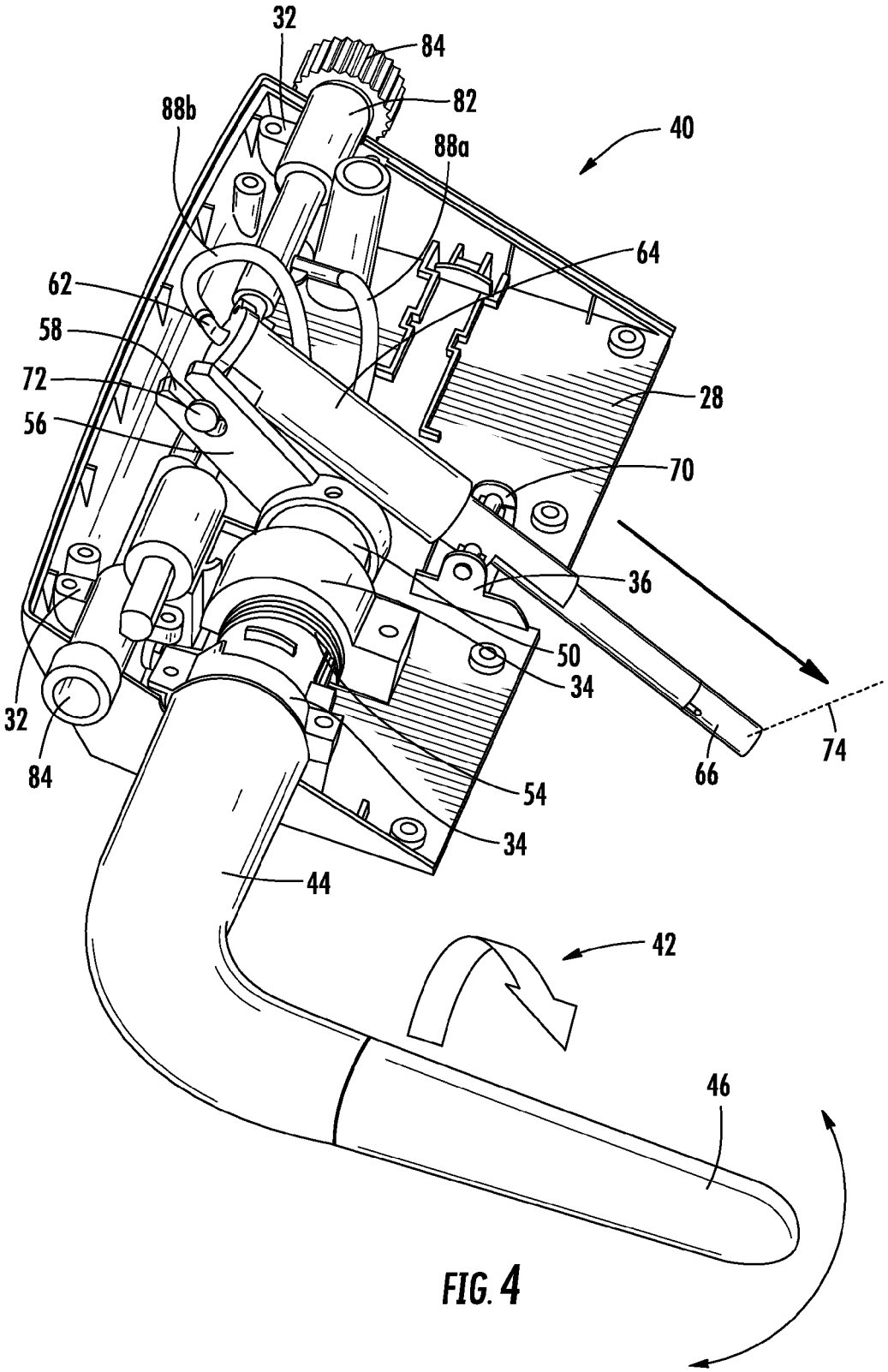
FIG. 4 is a perspective, partial cutaway view of a bidet assembly according to an exemplary embodiment with the sprayer shown in an extended position.

Referring generally to the figures, according to an exemplary embodiment, a manually operated bidet assembly 40 is provided for a toilet 2. The bidet assembly 40 generally includes a housing 26, a control lever or arm 42, a sprayer 60, and a water supply system 80, which are collectively configured to allow a user to control the direction and flow of a spray of water 74 for cleaning the user. More particularly, the control arm 42 is configured for a user to manually pivot the sprayer 60 into various positions or orientations to direct the spray of water 74 in a desired manner. The control arm 42 may further be configured to allow the user to manually adjust the flow of the spray of water 74.

According to an exemplary embodiment, the housing 26 generally includes a base 28 and a cover 30, which are collectively configured to serve as a chassis for mounting the bidet assembly 40 to the toilet 2. In particular, the base 28 and cover 30 cooperatively define a compartment for containing various components of the bidet assembly 40 and also include various features for operatively coupling components of the bidet assembly 40 to the toilet.

According to an exemplary embodiment, the base 28 is configured to mount the housing 26, and thereby the entire bidet assembly 40, to the toilet 2. In particular, the housing base 28 is configured to rigidly couple to a toilet base 10 of the toilet 2 toward a rearward position of a bowl 12 of the toilet 2. The housing base 28 may be coupled to the toilet base 10, for example, with the use of fasteners, seals, adhesives, complementary interferences features (e.g., clips, tabs, recesses, apertures, protrusions, etc.), or any suitable combination thereof. Further, the housing 28 may be configured to couple to a conventional toilet, such as for retrofitting an existing toilet, or a toilet that is specially configured for use with the bidet assembly 40.

According to an exemplary embodiment, the cover 30 is configured to define an upper portion of the compartment for containing various components of the bidet assembly. The cover 30 is configured to couple to the base 28, for example, with the use of fasteners, adhesives, interferences features, other methods, or any suitable combination thereof.

According to an exemplary embodiment, the bidet assembly 40 is part of a toilet seat assembly 20. The housing cover 30 is further configured to rotatably couple a lid 22 and a seat 24 to the toilet 2. In particular, the housing cover 30, lid 22, and seat 24 are configured for the lid 22 and seat 24 to operate in conventional manners by rotating between lowered and raised positions to cover the bowl 12 and provide a seating surface for the user, respectively. The housing cover 30, lid 22, and seat 24 include complementary mounting features (e.g., protrusions and recesses/apertures, hinge assemblies, etc.), which are positioned, shaped, sized, and otherwise configured to allow rotation of the lid 22 and seat 24 relative to each other and to the toilet 2. For example, the seat 24 may include interior and exterior protrusions, the interior protrusions being configured to be received by exterior apertures of the housing cover 30 and the exterior protrusions being configured to be received by interior apertures of the lid 22. According to other exemplary embodiments, the lid 22 and seat 24 may be configured to rotatably couple to the housing 26 in other manners including, for example, coupling the lid 22 and seat 24 to the housing base 28 or a single-piece housing 26, or coupling the lid 22 and seat 24 independently of each other to the base 28 or cover 30. According to still other exemplary embodiments, the bidet assembly 40 may be part of the toilet 2.

According to an exemplary embodiment, the water supply system 80 generally includes an inlet tube 82, a conduit or flexible tubing 88, and a flow control valve 86, which are collectively configured to selectively communicate water from one or more water sources to the sprayer 60.

According to an exemplary embodiment, the inlet tube 82 is a generally elongate, tubular structure configured to communicate water from one or more water supplies (e.g., hot and cold water supplies) to the tubing 88. The inlet tube 82 is configured to sealingly couple at each end 84 to one of the water supplies and at an intermediate or upstream portion to the tubing 88. For example, the inlet tube 82 may include various types of fittings (e.g., threaded, clamp, etc.), include a ribbed stem, or otherwise be configured to sealingly couple to the water supplies and tubing 88. According to some exemplary embodiments, the inlet tube 82 may be configured in other manners including, for example, to mix water (e.g., from hot and cold water supplies), or as a multi-piece structure.

According to an exemplary embodiment, the inlet tube 82 is disposed generally within the housing 26 and is mounted thereto. For example, the housing base 28 may include one or more brackets 32 for receiving and coupling the inlet tube 82 to the housing base 28. The housing base 28 and cover 30 may further include cutouts, such that ends of the inlet tubes 82 may protrude outside the housing 26 for coupling to the water supplies.

According to an exemplary embodiment, the tubing 88 is configured to communicate water to and from the flow control valve 86, which may be positioned within the control arm 42. A first segment of the tubing 88*a* extends from the water inlet tube 82 inside the housing 26 to the flow control valve 86 in the control arm 42. A second segment of the tubing 88*b* extends from the flow control valve 86 in the control arm 42 to the sprayer 60 in the housing 26. The tubing 88 is sealingly coupled to the inlet tube 82, flow control valve 86, and sprayer 60 in any suitable manner including, for example, with ribbed stems, fittings, or other configurations.

According to an exemplary embodiment, the tubing 88 is flexible or otherwise configured to be compliant (e.g., with flexible joints or other fittings) in order to move with the control arm 42 and sprayer 60. Movement of the control arm 42 and sprayer 60 is discussed in further detail below.

According to an exemplary embodiment, the flow control valve 86 is configured to selectively control a flow of water from the water supply system 80 to the sprayer 60 that forms the spray of water 74. The flow control valve 86 may be a conventional binary or progressive type of manually controlled valve (as opposed to electronically controlled) or any other type of valve suitable for being opened, being closed, or otherwise varying the flow of water. As discussed in further detail below, the flow control valve 86 is disposed within and coupled to the control arm 42, such that the user may manually manipulate the flow control valve 86 with the control arm 42.

According to an exemplary embodiment, the sprayer 60 includes an inlet 62, a wand 64, and a spray head 66, which are collectively configured to generate the water spray 74 for cleaning a user. More specifically, the inlet 62 is configured to receive water from the water supply system 80, the wand 64 receives water from the inlet 62, and the spray head 66 receives water from the wand 64 and ejects the water spray 74 from one or more nozzles thereof.

According to an exemplary embodiment, the sprayer 60 is generally contained within the housing 26. During operation, the wand 64 is configured to position and orient the spray head 66 for spraying water toward the user. In a first aspect, the wand 64 is configured to position the spray head 66 generally outside the housing 26 and under the user. More particularly, the wand 64 is configured for the spray head 66 to move laterally from inside the housing 26 to a position outside the housing 26. For example, the sprayer 60 may be configured as a nozzle portion detachably or permanently coupled to a piston portion, the piston portion configured to slide within the wand 64. In this manner, the spray head 66 extends from inside the wand 64 (and/or from inside the housing 26) in order to spray water and, thereafter, retracts to inside the wand (and/or to inside the housing 26). The sprayer 60 may also have a spring configured such that the telescopic extension and retraction occurs in response water pressure that is increased or decreased, respectively, within the wand 64. For example, the spring may be held in compression to force the spray head 66 into the retracted position when no water pressure is present within the wand 64 or spray head 66. When water pressure (e.g., greater than approximately 0.05 MPa or another pressure) is present within the wand 64 or spray head 66, the spring may be further compressed to allow the spray head 66 to move to the extended position.

According to an exemplary embodiment, in a second aspect, the wand 64 is configured to orient the spray head 66 such that the water spray 74 is at a particular angle or impacts a particular location of the user. More specifically, the spray head 66 may be oriented by pivoting or rotating the wand 64 into various. For example, the wand 64 may include an intermediately positioned post 70 that is received by a bracket 36 of the housing base 28 to form a pivot axis of the wand 64. The wand 64 may be pushed at a distal position relative the spray head 66, so as to pivot or rotate the wand 64 about the post 70 to change the position and angle of the spray head 66. According to one exemplary embodiment, the sprayer 60 is configured to pivot in a range of up to approximately 30 degrees. According to an exemplary embodiment, the 30 degree range of motion for the sprayer 60 may allow for an adjustable cleaning range or area on the user of approximately 55 mm (i.e., the positions of the user which the water spray 74 may impact), thus allowing the user to change the position of the water spray 74 according to physical characteristics of the user (e.g., male, female, size, shape, etc.) or the user's preferences.

According an exemplary embodiment, the control arm 42 generally includes outward, forward, and inward extending sections 44, 46, 50, which are collectively configured to allow a user to manually control operation of the sprayer 60. The inward extending section is disposed generally within the housing 26 and is operatively engaged with the wand 64. The outward and forward extending sections 44, 46 are interconnected and extend generally outward from the housing 26 to be within reach of the user for control of the sprayer 60.

Figure 5:
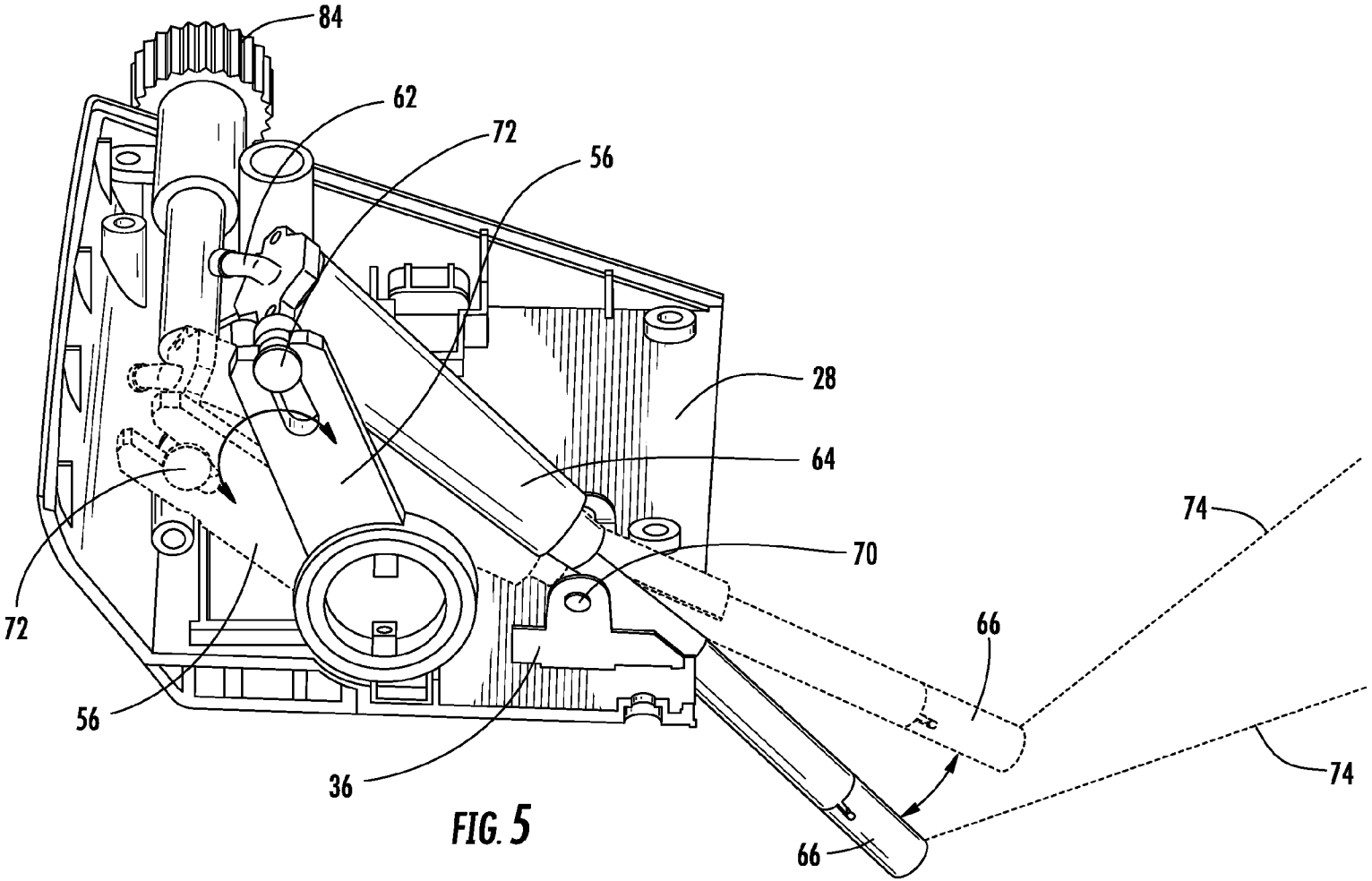
FIG. 5 is a perspective, partial cutaway view of a bidet assembly according to an exemplary embodiment showing the range of motion of the sprayer in the extended position.

According to an exemplary embodiment, the control arm 42 is configured to rotate relative to the housing 26 and is operatively engaged with the wand 64 for orienting the spray head 66. The housing base 28 includes brackets 34, which are operatively coupled to the inwardly extending section 50 and enable the control arm 42 to rotate about a fixed axis which is generally parallel to the pivot axis of the bidet wand 64. An arm 56 extends generally away from the inwardly extending section 50 of the control arm 42 and is configured to operatively engage the wand 64. More particularly, the arm 56 includes a slot 58 that engages a distally positioned post 72 of the sprayer 60. As shown in FIG. 5, for example, as the control arm 42 is rotated, the post 72 is pushed by the arm 56 and slides within the slot 58, such that the wand 64 pivots about the post 70 to change the orientation of the spray head 66. A spring 54 (e.g., torsion or other type) may also be coupled to the inwardly extending section 50 and the housing base 28, so as to provide resistance to the user's rotation of the control arm 42 and to return the control arm 42 to a resting position (e.g., a horizontal position). While other ranges of motion are contemplated, according to one exemplary embodiment, the range of motion of each of the control arm 42 and the sprayer 60 is approximately 30 degrees. Lesser and greater ranges of motion are contemplated, and the ranges of motion of the control arm 42 and sprayer 60 are not necessarily the same as each other.

According to an exemplary embodiment, the control arm 42 is also configured to allow a user to control the water flow to the sprayer 60. The control arm 42 includes a cavity 48 in which the flow control valve 86 is positioned. The forward extending section 46 of the control arm 42 is physically coupled to the control valve 86, such that movement of forward extending section 46 relative to the outward extending section 44 causes the flow control valve 86 to open, close, or otherwise adjust water flow to the sprayer 60. For example, the forward extending section 46 may be rotatably coupled to the outward extending section 44, such that the forward extending section 46 may be twisted or rotated by the user to open, close, or otherwise adjust the flow control valve 86. The forward extending section 46 may, for example, have a range of motion of approximately 90 degrees, while greater and lesser ranges of motion are also contemplated.

According to an exemplary embodiment, the arm 42 may also include markings or other indicia to indicate the water pressure in the sprayer 60, flow through the sprayer 60, or a position or state of the valve 86. For example, the outward extending section 44 may include a stationary indicator of relative or absolute pressure, flow, or position (e.g., with shading, quantity, or size of a figure such as water drops, alphanumeric characters, lines, gradations, etc.), while the forward extending section 46 includes a moving indicator (e.g., a line, dot, or other moving reference point) that is configured to move relative to the indicator when the forward extending section 46 rotates relative to the outward extending section 44. The position of the moving indicator relative to the stationary indicator will thus indicate to the user the relative or absolute water flow, water pressure, or valve position. The indicators may, for example, be molded, painted, or otherwise formed on the outward extending section 44 and forward extending section 46.

According to an exemplary embodiment, the user may control the bidet assembly 40 described above with the control arm 42 by rotating the outward extending section 44 relative to the toilet and by rotating the forward extending section 46 of the control arm 42. More particularly, the user may twist or turn the forward extending section 46 of the control arm 42 to open the flow control valve 86. The resulting water pressure in the wand 64 causes the spray head 66 to extend from the wand 64 such that it is positioned outside the housing 26 and under the user seated over the bowl 12 of the toilet 2 for the water spray 74 to clean the user. The user may then adjust the angle or position of the water spray 74 by rotating the outward extending section 44 of the control arm 42 relative to the toilet 2, for example, by pulling or pushing on the forward extending section 46. The user may adjust the flow or turn off the water spray 74 by twisting or turning the forward extending section 46 to further open or close the flow control valve 86. Furthermore, the position of the sprayer 60 and the water flow may be adjusted simultaneously, by simultaneously rotating the outward and forward extending sections 44, 46 of the control arm 42.

According to an exemplary embodiment, the bidet assembly 40 or the toilet seat assembly 20 may be provided in a method for retrofitting an existing toilet or providing a conventional toilet with a bidet assembly 40. For example, the method may include removing an existing toilet seat or otherwise preparing the toilet base 10 of the toilet 2 for mounting the bidet assembly 40 or toilet seat 20 to the toilet 2. The bidet assembly 40 or toilet seat assembly 20 is positioned on the toilet 2, for example, in proper alignment with mounting features of the toilet 2. The base 28 is then rigidly coupled to the base 10 of the toilet 2. The one or more water sources are configured for coupling to the inlet tube 82, for example, by sealingly coupling tubing to an existing water (e.g., for filling a tank of the toilet 2 or for a nearby faucet). Each end 84 of the water tube 82 is sealingly coupled to the one or more water sources, for example, with a threaded or other type of fitting.

According to other exemplary embodiments, the bidet assembly 40 and its components may be configured in various other manners. For example, the housing 26 may be provided in different manners, such as providing the base 28 without the cover 30, such that components of the bidet assembly 40 are exposed or are covered by other components of the toilet seat assembly 20 (e.g., covered by the lid 22 or seat 24) or the toilet 2 (e.g., the bidet assembly 40 is integrated with the toilet base 10). Similarly, the cover 30 may be provided without the base, such that components of the bidet assembly 40 are coupled directly to the toilet 2. The housing 26 may also be provided as a single-piece unit, or may include additional pieces. The bidet assembly 40 may be configured to position the spray head 66 in a different manner, such as sliding the spray head 66 forward into position, rotating the wand 64 about a vertical axis, or rotating the wand 64 from a generally vertical orientation. The bidet assembly may be configured to orient the wand 64 and spray head 66 in different manners, such as operatively engaging the control arm 42 with the wand 64 in a different manner (e.g., using gears, belt drives, or linkages, or fixedly coupling the control arm 42 to the wand 64 without intermediate engaging components).

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the bidet assembly and toilet seat assembly in the various exemplary embodiments are illustrative only.

Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A bidet assembly for a toilet, comprising:

a sprayer configured to spray water;

a water supply system configured to selectively communicate water from one or more water sources to the sprayer;

an arm operationally coupled to the water sprayer and to the water supply system;

wherein the arm is configured such that rotation of the arm about a first axis acts to rotate the sprayer and the arm further comprises a feature configured to allow control of water flow from the water supply to the sprayer;

wherein the arm extends radially away from the first axis and includes a valve positioned in a cavity thereof to control the water flow;

wherein the arm includes a first section configured to rotate about the first axis and which extends away from the first axis, and the arm includes a second section extending from the first section, the second section being configured to rotate relative to the first section to operate the valve for controlling the water flow.

2. The bidet assembly of claim 1, further comprising a base configured to couple to a toilet, wherein the sprayer is rotatably coupled to the base and the arm is rotatably coupled to the base.

3. The bidet assembly of claim 2, wherein the sprayer is configured to rotate about a second axis that is generally parallel with the first axis.

4. The bidet assembly according to claim 1, wherein a first segment of tubing communicates water to the valve, a second segment of tubing communicates water from the valve to the sprayer, and at least a portion of the first and second segments of tubing are disposed at least partially within the cavity of the arm.

5. The bidet assembly of claim 1, wherein the arm is configured such that rotation of the first section may occur simultaneously with rotation of the second section.

6. The bidet assembly of claim 1, wherein the sprayer is configured to rotate about a second axis and includes a post disposed at a distal position from the second axis, wherein the arm is configured to rotate about the first axis and includes an inner arm portion having a slot disposed at a distal position from the first axis, and wherein the post is disposed generally within the slot such that rotation of the arm causes the inner arm portion to push the post for rotating the sprayer.

7. The bidet assembly of claim 6, wherein the arm is configured to rotate up to approximately 30 degrees.

8. The bidet assembly of claim 6, wherein the sprayer is configured to rotate up to approximately 30 degrees.

9. The bidet assembly of claim 1, further comprising a housing;

wherein the sprayer is disposed generally within the housing in a retracted position and comprises an inlet, a wand, and a spray head; and wherein the spray head is configured to extend telescopically from the wand to a position generally outside the housing in an extended position.

10. The bidet assembly of claim 9, wherein the spray head extends telescopically from the wand in response to an increase of water pressure within the wand.

11. The bidet assembly of claim 10, wherein the sprayer includes a spring configured to retract the spray head into the wand in response to a decrease of water pressure within the wand.

12. The bidet assembly of claim 9, wherein:

the housing includes a base and a cover;

the base is configured to rigidly couple to the toilet, and the sprayer and arm are rotatably coupled to the base; and the cover is coupled to the base in a position to generally over the sprayer and an interior portion of the arm, and is configured to rotatably couple to a lid or a seat.

13. The bidet assembly of claim 1, wherein during use, a user may both rotate the arm about the first axis and rotate the second section relative to the first section without touching the first section.

14. The bidet assembly of claim 1, wherein the second section is configured to rotate about a second axis extending in substantially a same direction as which the arm extends away from the first axis.

15. A toilet seat assembly comprising:

a lid;

a seat; and a bidet system comprising a sprayer configured to spray water, a water supply system configured to selectively communicate water from one or more water sources to the sprayer, and an arm operationally coupled to the water sprayer and to the water supply system;

wherein the arm is configured such that rotation of the arm about a first axis acts to rotate the sprayer and the arm further comprises a feature configured to allow control of water flow from the water supply to the sprayer; and wherein the arm extends radially away from the first axis and includes a first section configured to rotate about the first axis and which extends away from the first axis to an end, and the arm includes a second section extending from the end, radially further away from the first axis than the first section and in substantially the same direction as the first section, the second section being configured to rotate relative to the first section to control the water flow.

16. The toilet seat assembly of claim 15, wherein the bidet assembly includes a base that is configured for coupling to a base of a toilet and further comprises an inlet tube configured to couple the bidet assembly to one or more water sources.

17. The toilet seat assembly of claim 15, wherein the sprayer is configured to rotate about a second axis that is generally parallel to the first axis.

18. The toilet seat assembly of claim 15, further comprising a valve mounted in a cavity of the arm, wherein the second section of the arm is configured to control the opening and closing of the valve when rotated relative to the first section.

19. The toilet seat assembly according to claim 18, wherein a first segment of tubing communicates water to the valve, a second segment of tubing communicates water from the valve to the sprayer, and at least a portion of the first and second segments of tubing are disposed at least partially within the cavity of the arm.

20. The toilet seat assembly of claim 15, wherein the arm is configured such that rotation of the first section may occur simultaneously with rotation of the second section.

21. The toilet seat assembly of claim 15, wherein the sprayer is configured to rotate about a second axis and includes a post disposed at a distal position from the second axis, wherein the arm is configured to rotate about the first axis and includes an inner arm portion having a slot disposed at a distal position from the first axis, and wherein the post is disposed generally within the slot such that rotation of the arm causes the inner arm portion to push the post for rotating the sprayer.

22. The toilet seat assembly of claim 15, further comprising a housing;

wherein the sprayer is disposed generally within the housing in a retracted position and comprises an inlet, a wand, and a spray head; and wherein the spray head is configured to extend telescopically from the wand to a position generally outside the housing in an extended position.

23. The bidet assembly of claim 22, wherein the spray head extends telescopically from the wand in response to an increase of water pressure within the wand and the sprayer includes a spring configured to retract the spray head into the wand in response to a decrease of water pressure within the wand.

24. The bidet assembly of claim 22, wherein:

the housing includes a base and a cover;

the base is configured to rigidly couple to the toilet, and the sprayer and arm are rotatably coupled to the base; and the cover is coupled to the base in a position to generally over the sprayer and an interior portion of the arm, and is configured to rotatably couple to a lid or a seat.

25. The bidet assembly of claim 15, wherein during use, a user may both rotate the arm about the first axis and rotate the second section relative to the first section without touching the first section.

26. The bidet assembly of claim 15, wherein the second section is configured to rotate about a second axis extending in substantially a same direction as which the arm extends away from the first axis.

* * * * *